United States Patent [19]

Sturesson

[11] 4,370,894

[45] Feb. 1, 1983

[54] ECCENTRIC ELEMENT

[76] Inventor: Rune K. Sturesson, Golfbanevägen 31, Halmstad, Sweden, S-302 70

[21] Appl. No.: 243,966

[22] PCT Filed: Jun. 26, 1980

[86] PCT No.: PCT/SE80/00179

§ 371 Date: Mar. 2, 1981

§ 102(e) Date: Mar. 2, 1981

[87] PCT Pub. No.: WO81/00123

PCT Pub. Date: Jan. 22, 1981

[30] Foreign Application Priority Data

Jul. 4, 1979 [SE] Sweden ..... 7905870

[51] Int. Cl.[3] ..... F16H 33/10

[52] U.S. Cl. ..... 74/87; 404/117; 74/61; 172/40

[58] Field of Search ..... 74/87, 61, 574; 464/117; 366/116, 125, 128; 172/40

[56] References Cited

U.S. PATENT DOCUMENTS

| | | | |
|---|---|---|---|
| 3,606,796 | 9/1971 | Pappers | 404/117 X |
| 3,814,532 | 6/1974 | Barrett | 404/117 |
| 4,034,614 | 7/1977 | Fors | 74/61 |
| 4,058,019 | 11/1977 | Braun | 74/87 |
| 4,105,356 | 8/1978 | Loveless | 404/117 |
| 4,236,417 | 12/1980 | Riedl | 74/87 |

FOREIGN PATENT DOCUMENTS

| | | |
|---|---|---|
| 2821755 | 5/1978 | Fed. Rep. of Germany . |
| 1387158 | 12/1964 | France . |
| 363867 | 2/1974 | Sweden . |

*Primary Examiner*—Nile C. Byers, Jr.

*Attorney, Agent, or Firm*—Birch, Stewart, Kolasch & Birch

[57] ABSTRACT

The invention relates to an eccentric element for generating oscillations in ground vibrators. The eccentric element comprises an eccentric mass (2) radially movable on a rotatable shaft (1). The mass is movable to assume a position displaced in relation to the centerline (15) of the shaft when the shaft (1) is rotated, thus causing the amplitude of the generated oscillation to be changed. To enable control of the amplitude, the eccentric mass (2) is lockable by means of a displaceable locking piston (9) arranged in a recess (16) in the rotating shaft (1). The locking piston (9) can thus assume a position entirely thrust-back into the recess (16), wherein the eccentric mass (2) is released, or a thrust-out position in which the locking piston fixes the eccentric mass (2) in one of its end positions.

8 Claims, 6 Drawing Figures

Fig. 1
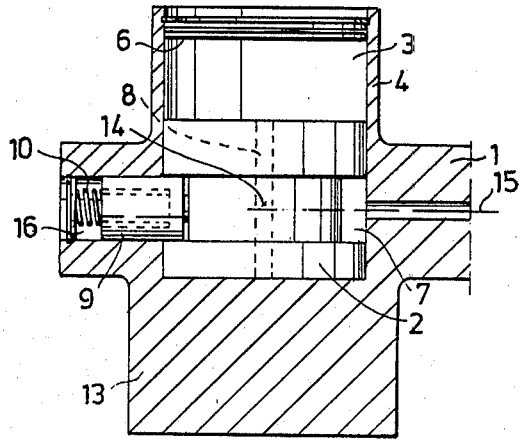
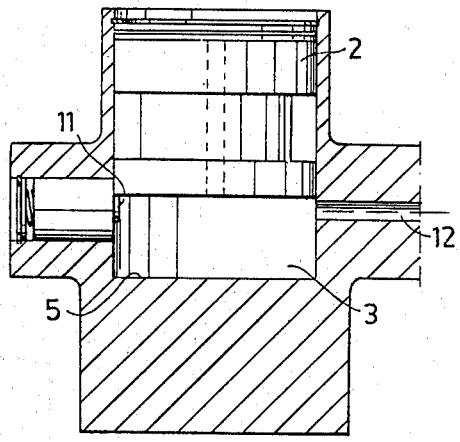
Fig. 2
Fig. 3
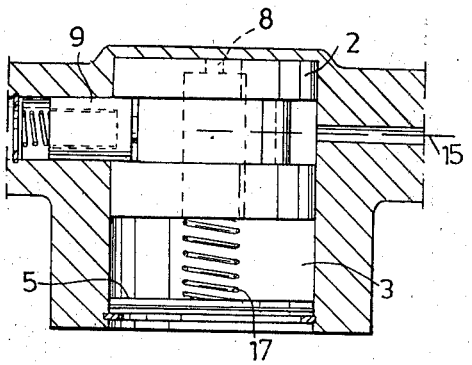

Fig. 4
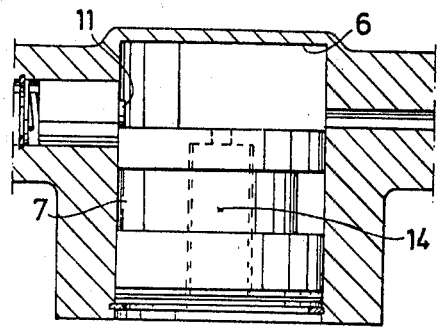
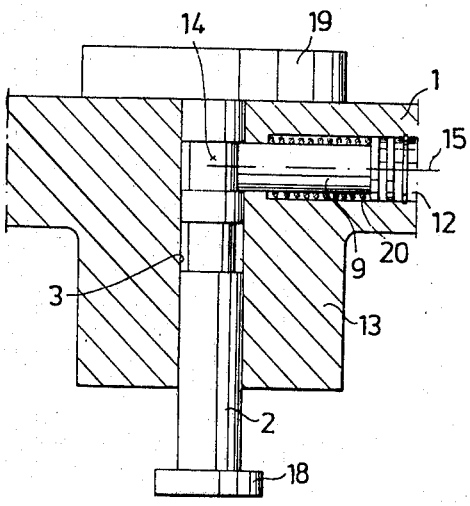
Fig. 5
Fig. 6
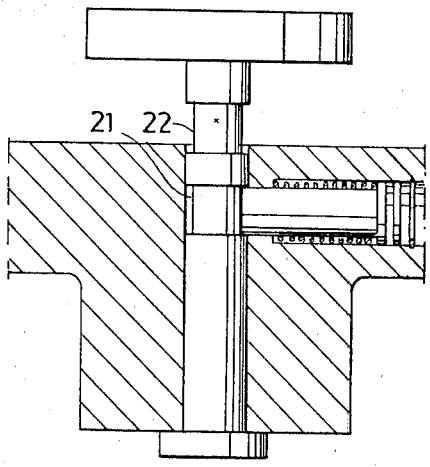

ECCENTRIC ELEMENT

BACKGROUND AND SUMMARY OF THE INVENTION

The invention relates to an eccentric element for ground vibrators, said element including a radially movable eccentric mass arranged on a rotatable shaft which can be caused to assume a position displaced in relation to the centreline of the shaft as a result of the rotation of said shaft.

It is often desirable to use the same ground vibrator, e.g. a vibrating roller, for compacting different types of paving material. However, since compacting of stone paving, for example, will be more effective if compaction is performed with an applied oscillation of higher amplitude and lower frequency than for asphalt paving, ground vibrators intended for such a wide range of uses should be provided with the possibility of changing the amplitude and frequency of the oscillation. In such cases, the amplitude can be changed by providing radially displaceable eccentric masses on a rotating shaft. So that the amplitude will not be changed during starting and stopping, or forward and reverse traversing, the position of the eccentric mass should be independent of the frequency of the shaft as well as its direction of rotation, otherwise depressions can easily occur when rolling asphalt paving, for example.

It is already known to dispose an eccentric mass displaceably and lockably in a cylindrical chamber. The displacement is provided by a hydraulic liquid acting on the eccentric mass formed as a piston sealed tightly against the cylinder wall, the position of the mass in the cylinder being determined by the quantity of liquid pumped in. The position of the eccentric mass is thus independent of both frequency and direction of rotation. Ground vibrators with eccentric elements of the kind mentioned will be complicated and expensive since a separate hydraulic system is required for operating the piston. Furthermore, the packings in the system are subjected to large stresses and therefore they often leak and give inexact positioning.

It is also known to arrange two radially displacable eccentric masses mutually lockable with the aid of a solenoid or locking pin. The eccentric masses are not commonly lockable however, but are kept in their rest position by a spring means which is dimensioned such that the centrifugal force overbalances at a certain rotational speed, one or both eccentric masses thus assuming a displaced position. This eccentric apparatus will also be relatively complicated, and the electrical or mechanical locking device will be subjected to large stresses due to shaking or vibration.

The present invention has the object of providing an eccentric element suitable for ground vibrators, and including a lockable eccentric mass, the displacement of which is independent of the direction of rotation and is not altered by alterations in speed of rotation, and which is also not burdened by the disadvantages accompanying the known eccentric elements mentioned.

The eccentric element in accordance with the invention includes an eccentric mass disposed radially movable on a rotatable shaft. Due to the rotation of the shaft, the mass can be caused to assume a position, displaced in relation to the centreline of the shaft. What is particularly characteristic for the invention is that the eccentric mass is lockable in its end positions by the action of a displaceable locking piston arranged in a recess in the rotating shaft and which can be controlled to assume a position thrust completely into the recess, wherein the eccentric mass is released, or a thrust-out position in which the locking piston fixes the eccentric mass in one of its end positions.

BRIEF DESCRIPTION OF THE DRAWINGS

The invention is described in the following while referring to the appended drawings.

FIG. 1 is a longitudinal section through a rotating shaft provided with an eccentric element in accordance with the invention, wherein the eccentric mass is arranged in a closed liquid-filled space and is locked in its inner position close to the centreline of the shaft.

FIG. 2 illustrates the same eccentric element with the eccentric mass locked in its outer displaced position.

FIGS. 3 and 4 illustrate another embodiment of the invention in corresponding positions, the eccentric mass being urged by a return spring.

In the same way, FIGS. 5 and 6 illustrate a further embodiment. In this case the eccentric mass is arranged for displacement in a cylindrical through-hole. The same reference numbers have been used for designating corresponding parts in the different embodiments.

DETAILED DESCRIPTION OF THE INVENTION

The eccentric element according to FIGS. 1 and 2 is thus disposed on a rotating shaft 1 and includes a movable eccentric mass 2 in a cylinder part 3. The cylinder part is defined by the cylinder wall 4 as well as lower and upper defining surfaces 5 and 6, respectively. The eccentric mass is formed as a piston with a cross section corresponding to that of the cylinder. A groove 7 is made round the circumference of the piston with a through-hole 8 being positioned in its longitudinal direction. A recess 16 is made in the rotating shaft 1, for a locking piston 9, which is urged by a helical spring 10 to assume a position projecting into the cylinder 3. The locking piston is formed with a central, projecting boss 11 adapted for maintaining the eccentric mass in its outwardly thrust position (FIG. 2). A hole 12 is made along the centre of the shaft 1 for supplying hydraulic liquid to the groove 7 and the cylinder from a rotatable shaft coupling at the end of the shaft. A fixed eccentric weight 13 is further arranged on the shaft 1.

The function of the eccentric element will now be described. In the position illustrated in FIG. 1, the centre of gravity 14 of the eccentric mass 2 is situated at a small distance from the centreline 15 of the rotating shaft. When the shaft 1 rotates, an oscillating movement of large amplitude occurs as a result of the eccentrically arranged mass 13. Centrifugal force acts on the eccentric mass 2 with a radial, outwardly directed force, but since the locking piston 9 engages in the groove 7, the eccentric mass 2 is retained in its inward position. If it is now desired to decrease the amplitude, the locking piston must be withdrawn so that the eccentric mass 2 can be thrust out by the rotation towards the upper limiting surface 6 of the cylinder 3, the resultant eccentric moment of the fixed mass 13 and the movable eccentric mass 2 decreases. To achieve this, the pressure in the hydraulic liquid is increased via the communication 12 by a hydraulic pump. The liquid pressure will thrust back the locking piston 9 and the eccentric mass will be thrust out to its outward position according to FIG. 2. The liquid pressure is subsequently decreased so that the piston 9 is urged against the eccentric mass 2 by the spring 10 with the boss 11 being positioned under the eccentric mass 2 and keeping it locked in its outer position. During movement of the eccentric mass, the hydraulic liquid flows through the hole 8, and movement of the eccentric mass can be dampened to a desirable degree by suitable adjustment of the size of the hole. The reverse setting from the position with low amplitude (FIG. 2) to the position with high amplitude (FIG. 1) takes place by stopping rotation, whereat the eccentric element assumes the position shown in FIGS. 1 and 2 with the larger fixed eccentric weight 13 situated bottommost. The hydraulic liquid pressure is thereafter increased so that the locking piston 9 is thrust into the recess 16, and the eccentric mass 2 falls down towards the lower defining surface 5 by gravity. The pressure is subsequently decreased and the locking piston 9 assumes the position where it is thrust into the groove 7.

In the embodiment according to FIGS. 3 and 4, a spring 17 is arranged between the eccentric mass 2 and the lower defining surface 5 of the cylinder. The eccentric element in this embodiment provides a lesser amplitude when the eccentric mass 2 is situated near the centreline 15 (FIG. 3), whereas the higher amplitude is achieved when the eccentric mass has assumed its displaced position (4). When the eccentric element is stationary, the eccentric mass 2 is urged towards the upper defining surface 6 of the cylinder by the action of the spring 17. The locking piston, which is operated in the same way as the previous embodiment, can thus engage in the groove 7. When the position with the higher amplitude is desired, the locking piston 9 is thrust back and the eccentric mass 2 is thrust out towards the lower defining surface 5, the spring 17 being compressed. When the eccentric mass has assumed its position (see FIG. 4), the locking piston can coact lockably with the eccentric mass by means of the boss 11. Setting in the opposite direction takes place by the rotation of the shaft 1 being caused to diminish such that the spring 17 can urge the eccentric mass 2 towards the upper defining surface 6 when the locking piston 9 is thrust back.

In the embodiment according to FIGS. 5 and 6, the eccentric mass 2 is movable in the cylinder 3, which is formed here as a cylindrical hole through the shaft 1 and the fixed eccentric mass 13. To limit the movement of the eccentric mass 2, it is formed with stops 18, 19, of which the one 19 has been given a greater mass, so that the centre of gravity 14 of the eccentric mass 2 can thus be given the desired position in relation to the centreline 15 of the rotating shaft 1. The locking piston 9 is arranged in a recess in the shaft 1 and is kept in its thrust-back position in the recess by a spring 20. Hydraulic pressure can be supplied to the locking piston 9 via a hole 12 in the shaft 1, for moving it out to its locking position.

In order to lock, the locking piston engages in one of the two grooves 21, 22 made on the eccentric mass 2. In the position according to FIG. 5, the eccentric mass 2 is locked in its inwardly-thrust position with the centre of gravity 14 situated close to the central axis 15. An oscillation of high amplitude occurs in this position when the shaft 1 is rotated, due to the effect of the fixed eccentric weight 13. If a setting to an oscillation with lower amplitude is desired, the exterior hydraulic pressure on the locking piston must be lowered so that the spring 20 can urge the locking piston back into its recess. The eccentric weight is then thrust by centrifugal force to its displaceable position with the centre of gravity 14 situated at a greater distance from the central axis 15 (FIG. 6). In this position the hydraulic pressure is once again increased on the locking piston 9, which is thrust into engagement with the groove 21. The reverse setting from high to low amplitude takes place by stopping rotation and thrusting the locking piston back, the eccentric mass 22 falling into its inner position by the action of gravity.

The invention is naturally not limited to the embodiments illustrated, and a plurality of variations are conceivable within the scope of the patent claims. It is thus also possible to control the locking piston in other ways than hydraulically, e.g. mechanically or electrically. It should be further emphasized that the cross-sectioned surface of the cylinder does not need to be circular but can be of optional form, and that the form and operation of the locking piston in the embodiments according to FIGS. 1–4 can be as for the embodiment illustrated in FIGS. 5–6.

I claim:

1. An eccentric element intended for ground vibrators, said element including a radially movable eccentric mass (2) arranged on a rotatable shaft (1), said mass being able to assume an inward position and as a result of the rotation of the shaft an outward position in which the distance between the centre of gravity (14) of the eccentric mass and the centreline (15) of the rotating shaft is larger than in the inward position, characterized in that the eccentric mass (2) is lockable in both its inward and outward position by the action of a displaceable locking piston (9) arranged in a recess (16) in the rotating shaft (1), and which can be manoeuvered to assume a position entirely thrust back into the recess (16) wherein the eccentric mass (2) is released, or a thrust-out position in which the locking piston (9) locks the eccentric mass (2) in its inward or outward position enabling the eccentric mass to be in its position independent of the speed of rotation of the shaft (1).

2. An eccentric element as claimed in claim 1, characterized in that the eccentric mass (2) is movable in a cylinder (3) substantially at right angles to the rotatable shaft (1), the recess (16) for the locking piston (9) being made in the cylinder wall (4).

3. An eccentric element as claimed in claim 1 or 2, characterized in that the eccentric mass (2) is formed with a groove (7) round its periphery, in which the locking piston (9) engages for locking the eccentric mass (2) in its inward position.

4. An eccentric element as claimed in claim 1 or 2, characterized in that the cylinder (3) and lower as well as upper defining surfaces (5) and (6), respectively, form a closed, liquid-filled space and that the eccentric mass (2) is formed as a piston movable in said space.

5. An eccentric element as claimed in claim 4, characterized in that the eccentric mass (2) is provided with a through-hole (8) in the direction of movement, liquid flowing through the hole (8) on movement of the eccentric mass (2).

6. An eccentric element as claimed in claim 5, characterized by a boss (11) formed on the locking piston (9) lockably coacting with one end surface of the eccentric mass (2) when the eccentric mass (2) is in its outward position, and that the liquid in the space can be put under pressure, the locking piston (9) then being thrust back into the recess (16) for liberating the eccentric mass (2).

7. An eccentric element as claimed in claim 6, characterized in that a spring (17) is arranged in the liquid-filled space, said spring urging the eccentric mass (2) in a direction towards the centreline.

8. An eccentric element as claimed in claim 1 or 2, characterized in that the eccentric mass (2) is formed with two grooves (21, 22) round its periphery, one for each respective locking position, the locking piston (9) engaging in either of these grooves (21, 22) when the eccentric mass (2) is locked, and that a spring means (20) is arranged to urge the locking piston (9) to assume the position thrust back into the cylinder wall, and that an outside force must be applied to the locking piston (9) to cause it to assume the thrust-out locking position.

* * * * *